US010504676B2

(12) United States Patent
Kalin et al.

(10) Patent No.: US 10,504,676 B2
(45) Date of Patent: Dec. 10, 2019

(54) VOLTAGE SOURCE CONVERTERS

(71) Applicant: General Electric Technology GmbH, Baden (CH)

(72) Inventors: Daniel Kalin, Oberentfelden (CH); Peter Von Allmen, Oberentfelden (CH)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 15/573,345

(22) PCT Filed: May 10, 2016

(86) PCT No.: PCT/EP2016/060430
§ 371 (c)(1),
(2) Date: Nov. 10, 2017

(87) PCT Pub. No.: WO2016/180822
PCT Pub. Date: Nov. 17, 2016

(65) Prior Publication Data

US 2018/0138002 A1 May 17, 2018

(30) Foreign Application Priority Data

May 11, 2015 (EP) ..... 15167157

(51) Int. Cl.
*H01H 3/30* (2006.01)
*H01H 33/40* (2006.01)
(Continued)

(52) U.S. Cl.
CPC ..... *H01H 71/12* (2013.01); *H01H 3/3052* (2013.01); *H01H 71/025* (2013.01); *H01H 33/40* (2013.01); *H01H 2235/01* (2013.01)

(58) Field of Classification Search
CPC ..... H01H 71/12; H01H 71/025; H01H 71/10; H01H 33/36; H01H 33/38; H01H 33/40; H01H 33/42; H01H 3/30; H01H 3/3052
(Continued)

(56) References Cited

U.S. PATENT DOCUMENTS 2,562,147 A 7/1951 Kuwayama
3,148,259 A * 9/1964 Jennings ..... H01H 33/38 200/286

(Continued)

FOREIGN PATENT DOCUMENTS

JP H09-259710 A 10/1997

OTHER PUBLICATIONS

Extended European Search Report and Opinion issued in connection with corresponding EP Application No. 15167157.5 dated Oct. 26, 2015.

(Continued)

*Primary Examiner* — Truc T Nguyen
*Assistant Examiner* — William A Bolton
(74) *Attorney, Agent, or Firm* — Eversheds Sutherland (US) LLP

(57) ABSTRACT

A spring arrangement for operating a high and medium voltage circuit breaker comprising a cylindrical housing having a main axis, an actuation rod, a coil spring arranged in the cylindrical housing, coupled with the rod, and a coupling arrangement coupling an end of the spring with an end of the rod, wherein the coupling arrangement comprises an articulation for guiding an end of the rod in rotation with respect to the second end of the spring around a second axis perpendicular to said main axis and comprises sliding means for the translational guiding of the second end of the rod along said main axis.

9 Claims, 1 Drawing Sheet

(51) Int. Cl.
*H01H 71/02* (2006.01)
*H01H 71/12* (2006.01)

(58) Field of Classification Search
USPC ..... 218/48, 28, 118, 120, 123, 134, 135
See application file for complete search history.

(56) References Cited

U.S. PATENT DOCUMENTS 3,921,109 A * 11/1975 Hodgson ..... H01H 1/54 335/195
5,932,858 A * 8/1999 Meinherz ..... H01H 33/53 218/84
6,649,854 B1 * 11/2003 Bauer ..... H01H 33/666 218/120
6,917,006 B2 * 7/2005 Bachofen ..... H01H 3/3052 200/318.2
6,927,356 B2 * 8/2005 Sato ..... H01H 33/666 218/154
8,242,399 B2 * 8/2012 van Dijk ..... H01H 33/42 200/400
8,309,871 B2 * 11/2012 Dupraz ..... H01H 3/38 200/400
8,807,547 B2 * 8/2014 Jung ..... H01H 5/06 200/400
8,916,790 B1 * 12/2014 Ando ..... H01H 33/666 218/154
2005/0067380 A1 * 3/2005 Rhein ..... H01H 33/6662 218/118
2012/0199456 A1 8/2012 Tak
2014/0158665 A1 * 6/2014 McCord ..... H01H 33/168 218/143
2014/0346147 A1 11/2014 Blanchet et al.

OTHER PUBLICATIONS

International Search Report and Written Opinion issued in connection with corresponding PCT Application No. PCT/EP2016/060430 dated Jul. 22, 2016.

* cited by examiner

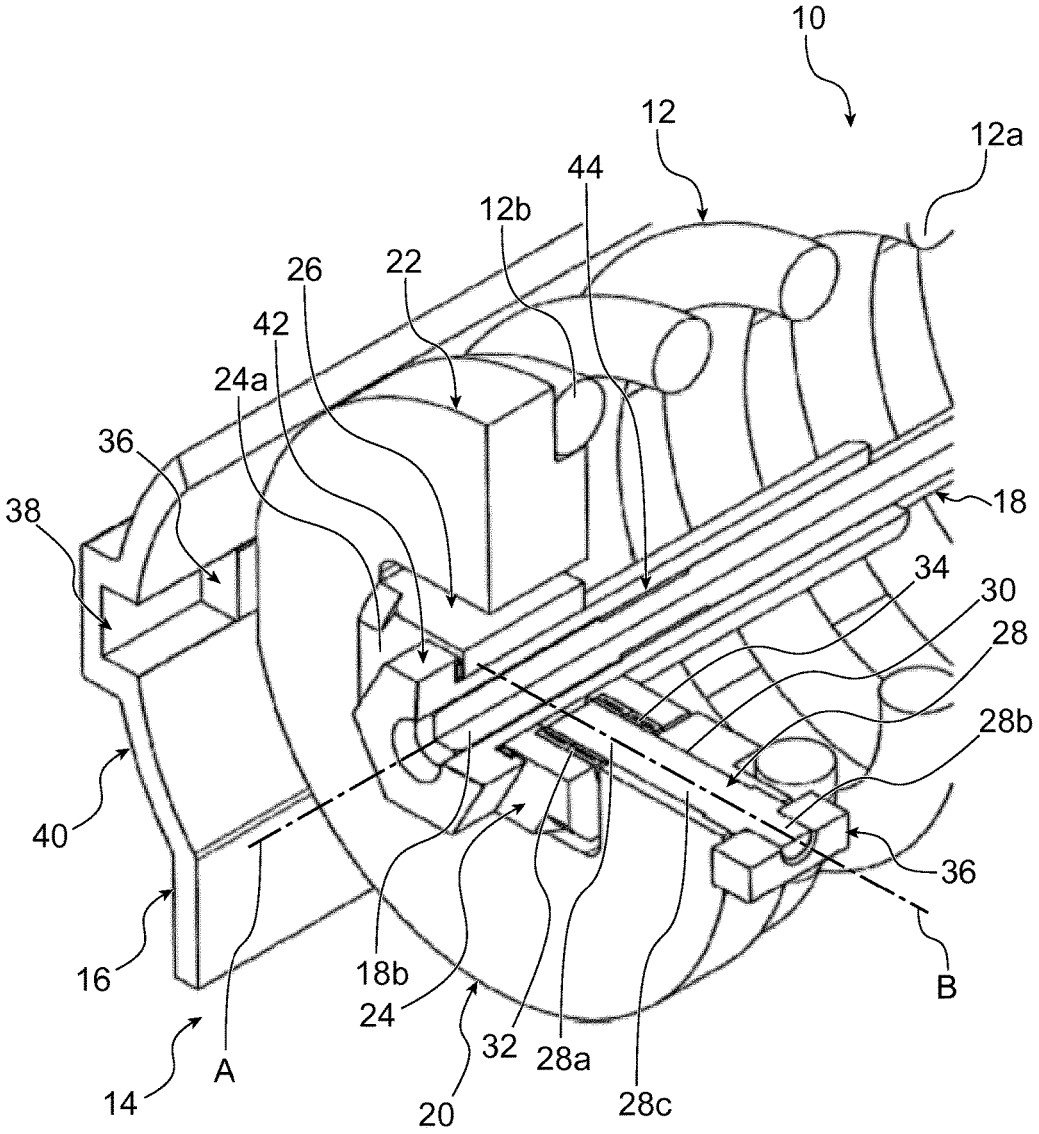
10
12
12a
44
12b
26
22
42
24a
36
38
18
34
30
28
28b
40
36
16
18b
24
32
28a
28c
B
14
A
20

VOLTAGE SOURCE CONVERTERS

TECHNICAL FIELD OF THE INVENTION

The present invention relates to a spring arrangement for a spring drive unit, e.g. for driving and controlling the opening and closing of an electrical switching apparatus, such as a switch or a circuit breaker.

The said switching apparatus is meant to be used in a high or a medium voltage transmission or distribution network.

BACKGROUND OF THE INVENTION

Spring arrangements, for example for a high- or medium-voltage circuit breaker, comprise compression springs to store an amount of energy to be released when the mechanism is operated.

The compression spring is linked to a rotating shaft of the apparatus by a flexible connection, to allow the action of the spring to be converted into a rotary action around the shaft's main axis.

An example of such a solution comprises a transmission shaft, both ends of which being articulated with the rotating shaft and a moving end of the compression spring, respectively.

The moving end of the spring is displaceable inside a cylindrical housing.

However, due to lateral forces on the moving end of the spring, the apparatus can sometimes jam. Moreover, the guiding surfaces must be made with the best surface finish.

An objective of an embodiment of the invention's goal is to provide a spring arrangement with enhanced means for guiding the mobile end of the spring inside the housing.

SUMMARY OF THE INVENTION

An embodiment of the invention concerns a spring arrangement for operating a high and medium voltage circuit breaker comprising a main frame comprising a cylindrical housing having a main axis A, an actuation rod, a first end of which being coupled to a rotary shaft of the circuit breaker, the second end of the rod being movable in the cylindrical housing along its main axis A, a coil spring arranged in the cylindrical housing and coaxially to main axis A, wherein a first end of the spring is mounted on the frame and the second end of the spring is coupled with the second end of the rod, and a coupling arrangement coupling the second end of the spring with the second end of the rod, wherein the coupling arrangement comprises an articulation for rotational guidance of the second end of the rod with respect to the second end of the spring around a second axis B perpendicular to said main axis A, which is located axially, along main axis A, at the second end of the spring and wherein the coupling arrangement comprises sliding means for the translational guiding of the second end of the rod along said main axis A.

In an embodiment, the coupling arrangement comprises a support plate mounted on the second end of the spring, the support plate is linked to the second end of the rod by said articulation and is linked to the housing by the sliding means.

In an embodiment, the coupling arrangement comprises at least one shaft coaxial to said second axis B, by means of which the support plate is pivotally linked to the second end of the rod.

In an embodiment, the second end of the rod is mounted on a plate articulated with respect to the support plate, around said second axis B by means of said at least one shaft.

In an embodiment, the coupling arrangement comprises at least one shaft coaxial to said second axis B, by means of which the support plate is linked to the sliding means.

In an embodiment, a portion of said shaft extends through the support plate and one end of the shaft is received in a groove of housing's wall, which is parallel to said main axis A.

In an embodiment, said end of the shaft supports a sliding shoe which is received in the groove, for lowering the friction between the shaft and the groove.

In an embodiment, said shaft extends radially from said main axis A, the radially internal end of the shaft being linked to the articulated plate by means of bearings and the radially external end of the shaft being received in the groove of the housing's wall.

In an embodiment, the arrangement comprises two coaxial shafts placed on both sides of said main axis A, the radially internal end of each shaft being linked to the articulated plate by means of bearings and the radially external end of each shaft being received in the groove of the housing's wall.

In an embodiment, the arrangement further comprises an adjusting bolt screwed on the second end of the rod, the adjusting bolt being in contact with a face of the articulated plate, which is opposite to the spring.

BRIEF DESCRIPTION OF THE DRAWINGS

The present invention will now be described in more detail with reference to the enclosed drawings, illustrating an embodiment of the invention as an example only, in which the unique FIG. 1 is a diagram of an embodiment of the claimed invention.

DETAILED DESCRIPTION OF THE INVENTION

The drawings represent a part of a spring arrangement 10 for driving and controlling the opening and closing of an electrical switching apparatus (not shown) like for example a high- or medium-voltage circuit breaker.

The arrangement 10 comprises a spring 12 for storing an amount of energy which is to be used for driving the switching apparatus.

The spring 12 is more particularly a coil spring, having a main axis A and it is received in a cylindrical housing 14 formed in a main frame 16.

The housing 14 is coaxial to main axis A of the spring 12 and is opened at its end close to the switching apparatus.

A first end 12A of the spring 12, here on the top right of the drawings, is located at the mouth (not shown) of the housing. This first end 12A of the spring 12 is fixed to the open end of the housing 14 by any known means. For example, the first end of the spring 12 is in abutment against a radial collar mounted at the end of the housing 14. The first end 12A of the spring 12 is then immobile.

The second end 12B of the spring 12 is movable inside the housing 14 along main axis A of the spring 12.

The arrangement 10 also comprises a transmission rod 18 for transmitting the energy stored in the spring 12 to the circuit breaker.

A first end (not shown) of the rod 18 is linked to a rotating shaft of the circuit breaker.

The second end 18*b* of the rod 18 is linked to the second end 12B of the spring 12.

The connection between the second end 18*b* of the rod 18 and the second end 12B of the spring 12 is realized by a coupling arrangement 20 that is designed to permit an oscillation of the rod 18 with respect to the second end 12B of the spring 12 around a second axis B oriented radially to main axis A of the spring 12.

The coupling means 20 are also designed in order to provide translational guidance of the second end 12B of the spring 12 along main axis A, inside the housing.

The coupling means 20 comprise a support plate 22 fixedly mounted on second end 12B of the spring. The support plate 22 is located inside the housing 14 and is linearly movable herein.

The support plate 22 extends in a radial plane, orthogonal to main axis A of the spring 12 and its shape corresponds to the radial section of the housing 14 across a radial plane.

The support plate 22 is articulated to the second end 18B of the rod 18 and is linearly guided within the housing 14.

The support plate 22 comprises a central opening 26 centered on main axis A, in which an articulated plate 24 is received.

The articulated plate 24 is fixed to the second end 18B of the rod and is pivotally mounted on the support plate 22 around secondary axis B.

The articulation means also comprise at least one shaft 28 coaxial with secondary axis B, which is fixedly mounted in a complementary hole 30 of the support plate 22.

Here, the arrangement 10 comprises two shafts 28 which are coaxial to secondary axis B and which are placed on both sides of said main axis A. however, it will be understood that the arrangement can comprise only one shaft 28.

Each shaft 28 extends radially from main axis A. A first end 28*a* of the shaft 28, located radially inwards, is located in the central opening 26 of the support plate 22 and is pivotally mounted in a corresponding hole 32 of the articulated plate 24, by means of bearings 34, e.g. needle bearings.

Then, while the arrangement 10 cooperates with the circuit breaker, the shaft 28 is free to oscillate around secondary axis B, while the second end 12B of the spring 12 and the second end 18B of the shaft translate along main axis A.

The support plate 22 is also guided in translation in the housing 14 along main axis A.

The guiding means comprise sliding shoes 36, here two sliding shoes placed on both sides of main axis A, which are mounted on the support plate 22. Each sliding shoe 36 is received in a respective groove 38 made in a wall 40 of main frame 16.

The groove 38 extends parallel to main axis A and is open radially facing main axis A.

The sliding shoes 36 are made of a material with good gliding performances. For example, the sliding shoes are made of polytetrafluoroethylene (PTFE), or of polyethylene (PE).

Each sliding shoe 36 is mounted on a second end 28B of the shaft 28 which extend radially outwards from the peripheral edge of the support plate 22.

Then, each shaft 28 comprises a first end 28A located radially inwards, which is received in a corresponding hole 32 of the articulated plate 24, a central part 28C received in a complementary through hole 30 of the support plate 22 and a second end 28B extending radially outwards from the peripheral edge of the support plate 22, on which a sliding shoe 36 is mounted.

The coupling means 20 also comprise means for adjusting the length of the rod 18, in order to adjust the force exerted by the spring 12 on the rod and on the rotating shaft of the circuit breaker.

The adjusting means comprise a bolt 42 which is in contact with a radial face 24A of the articulated plate 24. This radial face 24A is located opposite to the spring 12.

The bolt 42 further comprises a threaded sleeve 44 in which the second end 18B of the rod 18 is screwed.

Then, by screwing or unscrewing the bolt 42 on the rod 18, the pretension of the spring 12 can be adjusted.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A spring arrangement for operating a high and medium voltage circuit breaker comprising:

a main frame comprising a cylindrical housing having a main axis A, an actuation rod, a first end of which being coupled to a rotary shaft of the circuit breaker, a second end of the rod being movable in the cylindrical housing along the main axis A, a coil spring arranged in the cylindrical housing and coaxially to main axis A, wherein a first end of the spring is mounted on the claimed main frame and a second end of the spring is coupled with the second end of the rod, and a coupling arrangement coupling the second end of the spring with the second end of the rod, wherein the coupling arrangement comprises:

an articulation for rotational guidance of the second end of the rod with respect to the second end of the spring around a second axis perpendicular to said main axis wherein the second end of the rod and second axis are located axially, along main axis A, at the second end of the spring, and wherein the coupling arrangement comprises sliding means for a translational guiding of the second end of the rod along said main axis, and at least one shaft coaxial to said second axis, that pivotally links the support plate to the second end of the rod.

2. The spring arrangement according to claim 1, wherein the coupling arrangement comprises the support plate mounted on the second end of the spring, wherein the support plate is linked to the second end of the rod by said articulation and is linked to the housing by the sliding means.

3. The spring arrangement according to claim 2, wherein the coupling arrangement comprises at least one shaft coaxial to said second axis (B), by means of which the support plate is linked to the sliding means.

4. The spring arrangement according to claim 3, wherein a portion of said shaft extends through the support plate and one end of the shaft is received in a groove of housing's wall, which is parallel to said main axis.

5. The spring arrangement according to claim 4, wherein said end of the shaft supports a sliding shoe which is received in the groove, for lowering friction between the shaft and the groove.

6. The spring arrangement according to claim 1, wherein the second end of the rod is mounted on a plate articulated with respect to the support plate, around said second axis by means of said at least one shaft.

7. The spring arrangement according to claim 6, wherein the coupling arrangement comprises at least one shaft coaxial to said second axis, by means of which the support plate is linked to the sliding means and said shaft extends radially from said main axis, a radially internal end of the shaft being linked to the articulated plate by bearings and a radially external end of the shaft being received in a groove of the cylindrical housing's wall.

8. The spring arrangement according to claim 7, wherein the coupling arrangement comprises two coaxial shafts placed on both sides of said main axis, the radially internal end of each shaft being linked to the articulated plate by bearings and the radially external end of each shaft being received in the groove of the housing's wall.

9. The spring arrangement according to claim 1, further comprising an adjusting bolt screwed on the second end of the rod, the adjusting bolt being in contact with a face of an articulated plate, which is opposite to the spring.

* * * * *